US007383712B2

(12) United States Patent
Artel

(10) Patent No.: US 7,383,712 B2
(45) Date of Patent: Jun. 10, 2008

(54) TORQUE SUPPORT

(75) Inventor: Gerhard Artel, Kirchhundem (DE)

(73) Assignee: SMS Demag AG, Dusseldorf (DE)

( * ) Notice: Subject to any disclaimer, the term of this patent is extended or adjusted under 35 U.S.C. 154(b) by 89 days.

(21) Appl. No.: 10/578,537

(22) PCT Filed: Nov. 25, 2004

(86) PCT No.: PCT/EP2004/013390

§ 371 (c)(1),
(2), (4) Date: May 4, 2006

(87) PCT Pub. No.: WO2005/058518

PCT Pub. Date: Jun. 30, 2005

(65) Prior Publication Data

US 2007/0125146 A1 Jun. 7, 2007

(30) Foreign Application Priority Data

Dec. 18, 2003 (DE) ..... 103 59 404
Jan. 30, 2004 (DE) ..... 10 2004 002 784

(51) Int. Cl.
*B21B 31/07* (2006.01)

(52) U.S. Cl. ..... 72/237; 72/31.08; 72/247

(58) Field of Classification Search ..... 72/31.07, 72/31.08, 41, 199, 236, 237, 238, 249, 247
See application file for complete search history.

(56) References Cited

U.S. PATENT DOCUMENTS 2,906,106 A * 9/1959 Haas ..... 464/156
3,426,567 A * 2/1969 Smith ..... 72/240
4,000,979 A * 1/1977 Biondetti ..... 492/2
5,979,207 A * 11/1999 Seidl et al. ..... 72/249

FOREIGN PATENT DOCUMENTS

GB 1263898 2/1972

OTHER PUBLICATIONS

Renold Inc . . . Proud to Couplings & Gear Boxes.
Iron and Steel Engineer, No. 4, Apr. 1990, pp. 88.89.

* cited by examiner

*Primary Examiner*—Ed Tolan
(74) *Attorney, Agent, or Firm*—Abelman, Frayne & Schwab

(57) ABSTRACT

The invention relates to a torque support on oil collecting receptacles (2, 2') in a region of a paired connection of spindle heads and roll necks (1, 1') in rolling mill stands during adjustment thereof in both vertical and axial directions, with a respective attachment point on both upper and lower collecting receptacles (2, 2'). The new torque support consists of a one-piece strip (3) having, in particular, a rectangular cross-section and formed of flection-resistant material, and which is pivotally connected at an upper end with the upper oil collecting receptacle (2) in a vertical plane by an articulated joint (4) and, in a region of its lower end (9), is slidably guided in the pendulum plane in formlockingly compatible opening (5) of a guide link member (6) so that the distance and the inclination angle (α) change.

5 Claims, 3 Drawing Sheets

TORQUE SUPPORT

This application is a 35 USC 371 of PCT/EP04/13390, filed Nov. 25, 2004.

The invention relates to a torque support on oil collecting receptacles in a region of a paired connection of spindle heads and roll necks in rolling mill stands during adjustment thereof in both vertical and axial directions, with a respective attachment point on both upper and lower collecting receptacles.

The rolling mill stands of hot rolling mills are connected with motor-gear transmission units by splined articulated spindles. A separate splined articulated spindle is connected with a roll neck, e.g., of a working roll at its spindle head. On the rotatable spindle heads, relatively heavy oil collecting receptacles are supported on roller supports. Because the rolls in a rolling mill occupy changeable positions, the adjustment of spindle heads and, thereby, the adjustment of the oil collecting receptacles in both horizontal and axial directions is required.

Figure 1:
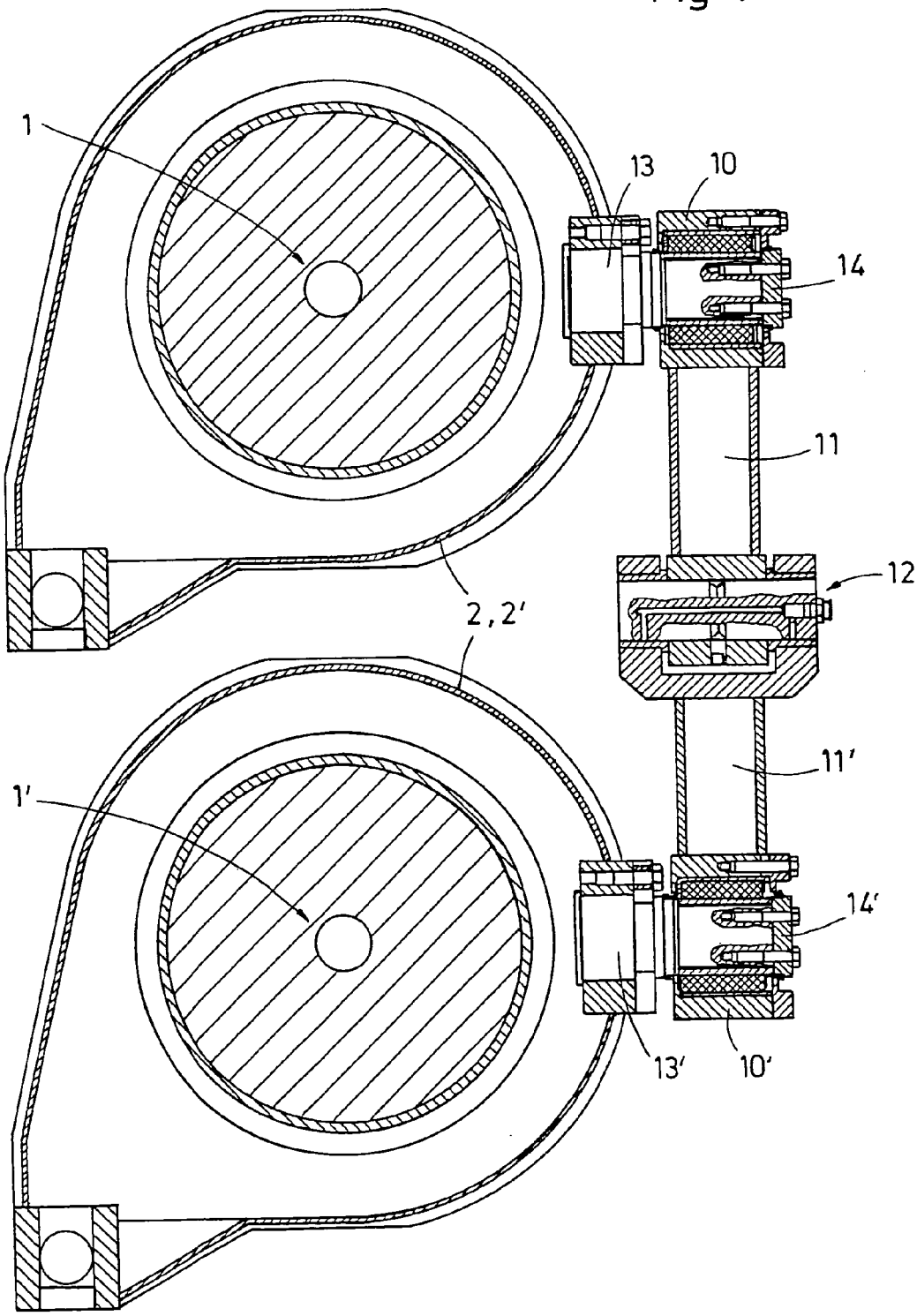

According to the state of the art, for a spacing distance-changeable attachment of the oil collecting receptacles, toggle levers connectable with articulated joints, such as shown in the attached FIG. 1, are used. Such a toggle lever connection consists of two tubular members connected with each other by an intermediate articulated joint.

Two end heads are welded on the opposite ends of the toggle lever. On the oil collecting receptacles, attachment bolts, onto which the end heads are pinned on, are provided, and which are held in an articulated handle and are secured with a plate.

With this type of attachment or positioning of the attachment points on the upper and lower oil collecting receptacles, the position of the attachment points changes upon adjustment of the working rolls in a vertical and/or axial direction during rolling in the rolling direction, which leads to vibrations in the toggle lever, which in the course of the operation, destroy the connection of the toggle lever.

The design of the presently used toggle lever contemplates use of several separate components which should be welded with each other. Both the articulated joint and the attachments on the oil collecting receptacles require an adequate supply of a lubricant. With a relatively large weight of connectable with each other, toggle lever parts, a crane should be used during the assembly.

The known state of the art has a number of drawbacks. Those include:

- vibrations of the toggle lever at a non-smooth running of the spindle head.
- at strong vibrations, the connection of the toggle lever is destroyed.
- difficult assembly as a result of large weight.

Document DE 1 902 894 describes a splined articulated spindle for a rolling mill drive with a device for circular lubrication.

The device includes a grooved ring which surrounds the spindle shank in a sealingly tight manner and is held without possibility or rotation relative thereto, which serves for feeding oil, and from which oil is fed to splined articulations through channels of the spindle shank; a non-rotatable casing for removing oil and which surrounds the spindle shank at a distance therefrom; and an oil delivery pump having its suction side connected with the casing, if necessary, with an insertion therebetween of a cooling device, and its pressure side connected with the grooved ring. The annular body is supported on the spindle shank within the or an oil-removing casing, and the one or several splined articulations extend at least partially into the oil-removing casing. Guide walls, which are arranged on the spindle sleeve and project into the casing, form a leak connection. The casings, which are associated with roll-side spindle heads of both splined articulated spindles, are supported on common guide rails with a possibility of both displacement in the vertical direction and the displacement relative to each other in the axial direction. The guide rails secure the casings against rotation with splined articulated spindles.

Proceeding from the foregoing state of the art, the object of the invention is to provide a significantly improved torque support in the region of connection of the spindle heads with the roll necks, and to insure a lasting operational reliability, absence of maintenance costs, and a simplified assembly.

For solving the existing problem, the invention suggests use of a one-piece torque support instead of the above-described multi-part toggle lever. It is formed, according to the invention, of a one-piece strip having, in particular, a rectangular cross-section and formed of flection-resistant material, is pivotally connected at an upper end with the upper oil collecting receptacle in a vertical plane by an articulated joint and, in a region of its lower end, is slidably guided in the pendulum plane in formlockingly compatible opening of a guide link member so that the distance and the inclination angle $\alpha$ change. This torque support is constructively simple and insures an easy and flexible connection without any problem.

According to one embodiment, the guide link member is formed of a pair of plan-parallel broad side walls and narrow side walls forming together a rectangular guide opening.

According to an advantageous embodiment, the broad side walls are spaced from each other by a distance such that they form a sliding fit for the strip. Preferably, the narrow side walls are convexly shaped toward an interior of the guide link member, so that the strip can still oscillate.

It is further provided that the rectangular strip is formed of a glass fiber-reinforced plastic material such as laminated cloth or glasshard cloth for an oil-free operation.

Further particularities, features, and advantages of the present invention will follow from a following description of an embodiment schematically shown in the drawings.

Figure 2:
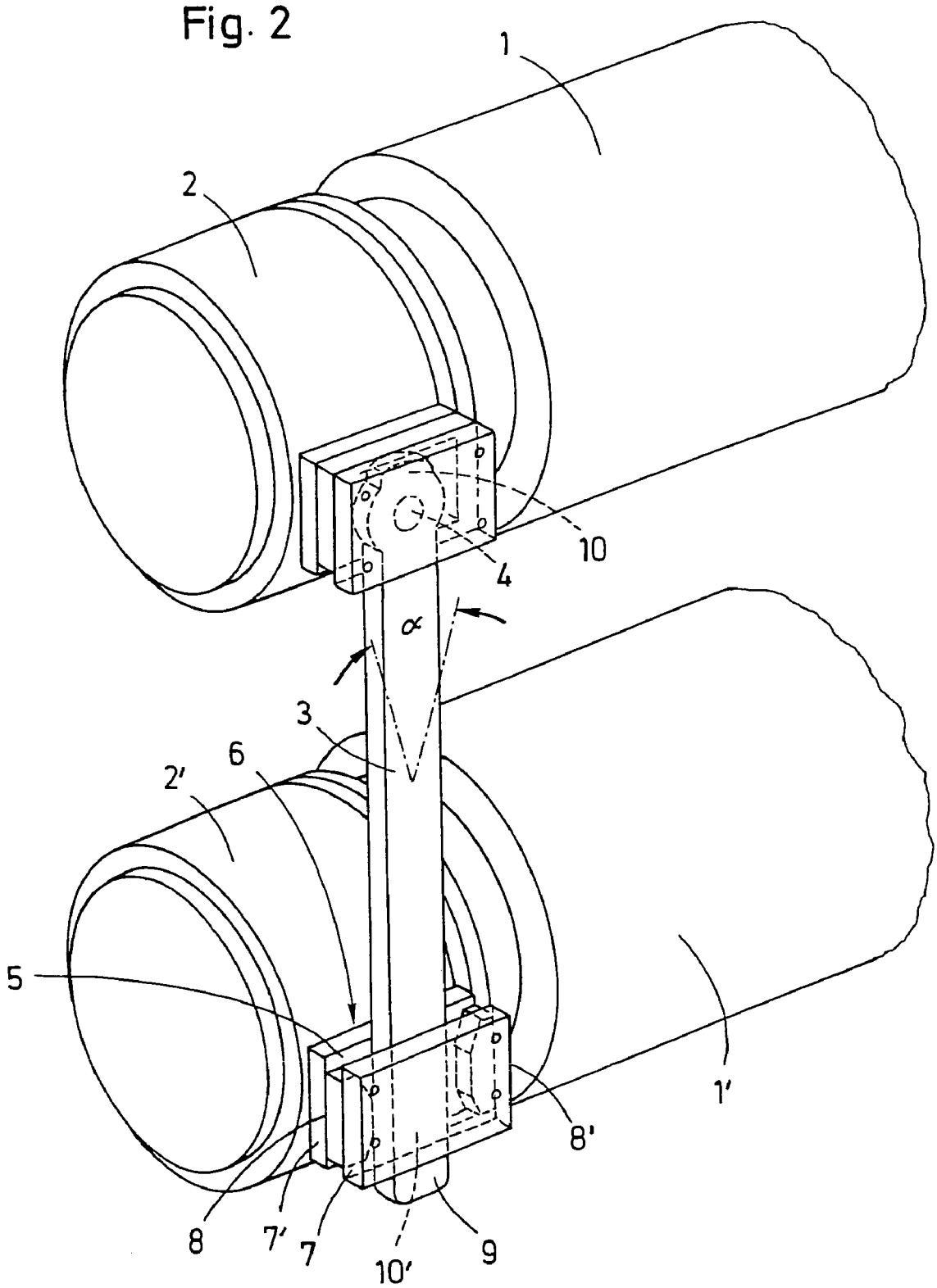
Figures 3, 3A, 3B:
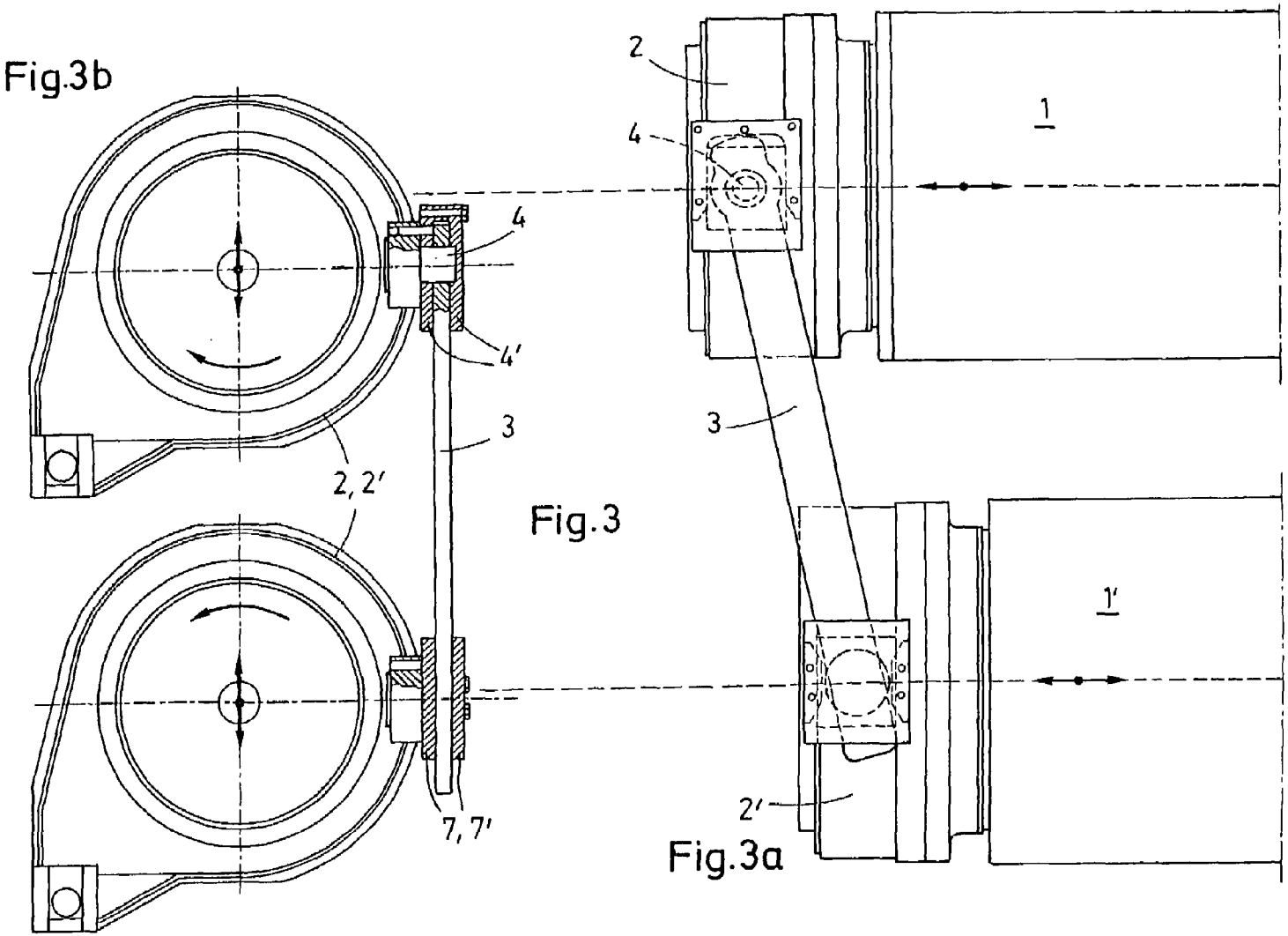

The drawings show:

FIG. 1 a side cross-sectional view of an embodiment of a torque support according to state of the art with an articulated toggle lever forming link joints with upper and lower oil collecting receptacles;

FIG. 2 a perspective view showing an arrangement of a torque support according to the present invention on oil collecting receptacles with a possibility of adjustment in both vertical and axial directions;

FIG. 3 a plan (FIG. 3*a*) and a side, partially cross-sectional (FIG. 3*b*) views of the torque support according to FIG. 3.

A torque support according to the state of the art, which is shown in FIG. 1 in cross-section, has its spindle heads of splined articulated spindles located within end side oil collecting receptacles 2, 2' which surround the same. A toggle lever, which is shown in FIG. 1, is formed of two tubular members 11, 11' connected with each other by an articulated joint 12 provided at their respective ends. At the other respective ends of the tubular members 11, 11', there are secured, e.g., by welding, end heads 10, 10'. On the oil collecting receptacles, there are provided attachment bolts 13, 13' onto which the end heads 10, 10 are pinned on and are secured with plates 14, 14'. The position of the attachment bolts 13, 13' on the upper and lower oil collecting receptacles 2, 2' changes upon adjustment of working rolls of the rolling mill stand, together with articulated spindles, in vertical and/or axial direction during rolling, which leads to vibrations in the toggle lever, which in course of time, can destroy the connection of the toggle lever 11, 11'. A further drawback consists in that the presently used toggle lever consists of several separate components which should be connected with each other. Lubrication of the articulated joint is absolutely necessary.

The design of the torque support according to the invention is shown in detail in FIGS. 2 and 3, once in perspective view (FIG. 2) and, on the other hand in (FIG. 3), once in a plan view (FIG. 3*a*) and once in a side view (FIG. 3*b*). As shown in FIGS. 2 and 3, according to the invention, instead of the above described toggle lever 10, 11, 12 according to FIG. 1, the new torque support, in a simplest embodiment, is formed of a rectangular strip 3 that can be, preferably, formed of a glass fiber-reinforced plastic material such as glasshard cloth or laminated cloth. For attaching the support at an upper attachment point 10, there are provided an articulated joint 4 with a hinge bolt located in a compatible bore.

In the region of the lower end 9 of the strip 3, the strip is received in a formlockingly compatible recess 5 of a guide link member 6 and is slidably guided in the pendulum plane so that the distance and the inclination angle $\alpha$ change.

As further shown in FIGS. 2 and 3, the guide link member 6 is formed of respective pairs of plan-parallel broadwide walls 7, 7' and narrow side walls 8, 8', which form together the rectangular recess 5. In FIG. 2, the side walls of the articulate joint 4 are designated with 4', whereas the broad side walls and narrow side walls are designated with 7, 7' and 8, 8', respectively, with formation of the rectangular opening designated within. The broad side walls 7, 7' are so spaced from each other that they form a sliding fit for the strip 3. As a result, they can slidably follow without a problem and without the use of lubrication, the distance-changing movement of the working rolls or the articulated spindles and, additionally, the angle $\alpha$, which is shown in FIG. 2, of the displacement position of the working roll. The inner surfaces of the narrow side walls are convexly-shaped.

The invention claimed is:

1. A torque support on oil collecting receptacles (2, 2') in a region of a paired connection of spindle heads and roll necks (1, 1') in rolling mill stands during adjustment thereof in both vertical and axial directions, with each of the upper and lower oil collecting receptacles (2, 2') having an attachment point, the torque support comprising an integral strip (3) having a rectangular cross-section, formed of a flection-resistant material, and extending in a vertical plane between the attachment points of the upper and lower oil collecting receptacles (2, 2'); an articulated joint (4) provided at the attachment point of the upper oil collecting receptacle (2) for pivotally connecting the strip (3) to the upper oil collecting receptacle (2) for enabling a pendulum movement of the strip (3) in the vertical plane; and a guide link member (6) provided at the attachment point of the lower oil collecting receptacle (2) and having an opening (5) for formlockingly receiving a strip lower end (9), the opening (5) providing for changing a distance between the attachment points and an inclination angle (a) of the strip (3).

2. A torque support according to claim 1, wherein the guide link member (6) is formed of a pair of plan-parallel broad side walls (7, 7') and narrow side walls (8, 8'), forming together a rectangular guide opening (5).

3. A torque support according to claim 2, wherein the broad side walls (7, 7') are spaced from each other by a distance such that they form a sliding fit for the strip (3).

4. A torque support according to claim 2, wherein the narrow side walls (8, 8') are convexly shaped toward an interior of the guide link member(6).

5. A torque support according to claim 1, wherein the strip (3) is formed of a glass fiber-reinforced plastic material suitable for an oil-free operation.

* * * * *